US007455121B2

(12) United States Patent
Saito et al.

(10) Patent No.: US 7,455,121 B2
(45) **Date of Patent: *Nov. 25, 2008**

(54) POWER TOOL

(75) Inventors: Takuma Saito, Ibaraki (JP); Shinki Ohtsu, Ibaraki (JP); Yasuki Ohmori, Ibaraki (JP); Chikai Yoshimizu, Ibaraki (JP); Katsuhiro Oomori, Ibaraki (JP); Masanori Watanabe, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/948,539

(22) Filed: Sep. 24, 2004

(65) Prior Publication Data

US 2005/0061521 A1 Mar. 24, 2005

Related U.S. Application Data

(63) Continuation of application No. 10/085,585, filed on Mar. 1, 2002, now Pat. No. 7,048,075.

(30) Foreign Application Priority Data

Mar. 2, 2001 (JP) ..... P2001-058625

(51) Int. Cl.
*B25B 19/00* (2006.01)

(52) U.S. Cl. ..... 173/93.5; 173/162.2; 173/210; 173/176; 173/178; 173/216; 173/48; 74/411; 74/443; 74/440; 464/74; 464/76; 464/51

(58) Field of Classification Search ..... 173/93, 173/93.6, DIG. 2, 162.2, 210, 178, 176, 216, 173/93.5, 48; 464/74, 76, 51; 74/411, 443, 74/440

See application file for complete search history.

(56) References Cited

U.S. PATENT DOCUMENTS

| | | | | |
|---|---|---|---|---|
| 2,341,497 | A | 2/1944 | Amtsberg | |
| 3,174,606 | A | 3/1965 | Hornschuch et al. | |
| 3,392,793 | A | 7/1968 | Pauley | |
| 3,768,577 | A * | 10/1973 | Leoni | 173/93 |
| 3,837,179 | A | 9/1974 | Barth | 464/76 |
| 4,503,719 | A | 3/1985 | Hamano | |
| 4,585,078 | A | 4/1986 | Alexandrov et al. | |
| 4,779,470 | A | 10/1988 | Morita et al. | 464/76 |
| 5,339,908 | A | 8/1994 | Yokota et al. | |
| 5,601,149 | A * | 2/1997 | Kawasaki et al. | 173/93.5 |
| 5,706,902 | A * | 1/1998 | Eisenhardt | 173/93.5 |
| 5,816,102 | A | 10/1998 | Kern et al. | 464/76 |
| 5,873,786 | A | 2/1999 | Hosoya et al. | |
| 5,924,928 | A | 7/1999 | Stegman et al. | 464/76 |
| 6,045,448 | A | 4/2000 | Kern et al. | 464/74 |

(Continued)

FOREIGN PATENT DOCUMENTS

DE 11 88 517 1/1957

(Continued)

*Primary Examiner*—Rinaldi I. Rada
*Assistant Examiner*—Michelle Lopez
(74) *Attorney, Agent, or Firm*—McGinn IP Law Group PLLC

(57) ABSTRACT

A power tool includes an impact damping mechanism for damping an impact in a direction of rotation of a speed reduction mechanism portion 8.

5 Claims, 7 Drawing Sheets

U.S. PATENT DOCUMENTS

| | | | | |
|---|---|---|---|---|
| 6,098,726 | A * | 8/2000 | Taylor et al. | 464/76 |
| 6,131,477 | A | 10/2000 | Gaydek et al. | 464/74 |
| 6,155,356 | A | 12/2000 | Kikuchi et al. | |
| 6,457,535 | B1 * | 10/2002 | Tanaka | 173/178 |
| 6,705,410 | B2 | 3/2004 | Ziegler | 173/201 |

FOREIGN PATENT DOCUMENTS

| | | | |
|---|---|---|---|
| DE | 1 188 517 | B1 | 6/1965 |
| DE | 19 56 210 | C3 | 5/1971 |
| DE | 29 12 718 | A1 | 3/1979 |
| DE | 195 05 068 | C2 | 2/1995 |
| EP | 0 230 843 | A1 | 8/1987 |
| EP | 0 529 456 | A1 | 3/1993 |
| JP | 63-186054 | | 8/1988 |
| JP | 2-130711 | | 10/1990 |
| JP | 02-130711 | | 10/1990 |
| JP | 07-31281 | | 6/1995 |

* cited by examiner

RELATED ART

POWER TOOL

The present Application is a Continuation Application of U.S. patent application Ser. No. 10/085,585, filed on Mar. 1, 2002, now U.S. Pat. No. 7,048,075.

BACKGROUND OF THE INVENTION

1. Field of the Invention

This invention relates to a power tool such as an impact screwdriver and an oil pulse screwdriver.

2. Description of the Related Art

A conventional power tool will be described with reference to FIG. 8. FIG. 8 is a partly-omitted, vertical cross-sectional, side-elevational view showing an impact tool for imparting a rotational force and a striking force to an end tool 20 such as a bit. Generally, a motor 2, serving as a drive source, a speed reduction mechanism portion 8 for transmitting a rotational power of a pinion 4 which is an output shaft of the motor 2, a spindle 14 for transmitting the rotational power from the speed reduction mechanism portion, a hammer 15, which is rotatable and movable in a direction of the axis of rotation through steel balls 16 inserted in cam grooves 14*a* formed in the spindle 14, an anvil 17, having anvil claws 17*b* which are struck by a plurality of hammer claws 15*b*, provided at the hammer 15, to be rotated, the end tool 20, releasably attached to the anvil 17, and a spring 12, normally urging the hammer 15 toward the anvil 17, are received within a housing 1 and a casing 10 which form an impact tool body. The speed reduction mechanism portion includes a fixed gear support jig 7, which has rotation stoppers, and is supported within the housing 1, a fixed gear 6, planetary gears 8, and the spindle 14, and further includes needle pins 9 serving as rotation shafts for the planetary gears 8, and the gears 8 and the needle pins 9 form part of the spindle 14. One end the spindle 14 is borne by a bearing 11, and the other end thereof is rotatably supported in a central hole 17*a* in the anvil 17 rotatably supported by a metal bearing 18.

A trigger switch 3 is operated to supply electric power to the motor 2 to drive this motor 2 for rotation, and then the rotational power of this motor 2 is transmitted to the planetary gears 8 through the pinion 4 connected to the distal end of the motor 2, and the rotational power of the pinion 4 is transmitted to the spindle 14 through the needle pins 9 by the meshing engagement of the planetary gears 8 with the fixed gear 6, and the rotational force of the spindle 14 is transmitted to the hammer 15 through the steel balls 16 each disposed between the cam groove 14*a* of the spindle 14 and a cam groove 15*a* of the hammer 15, and the hammer claw 15*b* of the hammer 15, urged forward (toward the bit) by the spring 12 provided between the hammer 5 and the planetary gears 8 of the spindle 14, strikes the anvil claw 17*b* of the anvil 17 as a result of the rotation, thereby producing a pulse-like impact which is imparted to a screw, a nut or the like to be tightened by the end tool 20. After the striking operation, the striking energy of the hammer 15 decreases, and the torque of the anvil 17 decreases, whereupon the hammer 15 rebounds from the anvil 17, and therefore the hammer 15 moves toward the planetary gears 8 along the cam grooves 15*a* and 14*a*. Before the hammer 15 impinges on a stopper 22, the hammer 15 is again moved back along the cam grooves 15*a* and 14*a* toward the anvil 17 by the compressive force of the spring 12, and the hammer 15 is accelerated by the rotation of the spindle 14 through the steel balls 16 each disposed between the cam groove 14*a* of the spindle 14 and the cam groove 15*a* of the hammer 15. During the reciprocal movement of the hammer 15 toward the stopper 22 along the cam grooves 14*a* and 15*a*, the spindle 14 continues to rotate, and therefore in the case where the hammer claw 15*b* of the hammer 15 moves past the anvil claw 17*b* of the anvil 17, and again strikes the anvil claw 17*b*, the hammer 15, when rotated through 180°, strikes the anvil 17. Thus, the anvil 17 is repeatedly struck by the axial movement and rotation of the hammer 15, and by doing so, the screw or the like is tightened while continuously imparting the impact torque thereto.

As described above, by the rotation and axial movement of the hammer, the hammer claw of the hammer was caused to repeatedly impinge on the anvil claw of the anvil, thereby imparting the impact torque to the anvil. However, in the case of driving the screw into a hard wooden material or in the case of fastening a bolt to an iron plate, the rebounding force, produced by the anvil upon impingement, was very large, so that the hammer was moved back until it impinged on the stopper provided at the spindle. Therefore, each time the hammer impinged on the stopper, there was exerted a force to instantaneously lock (press) the rotating spindle. Therefore, even when the locking effect acted on the spindle, a large load (rotational impact force) was exerted on the gear portions of the speed reduction mechanism portion, provided between the motor and the spindle, since the pinion of the motor was rotating, and as a result there was encountered a problem that the speed reduction mechanism portion and the housing, holding this speed reduction mechanism portion, were damaged. And besides, a locking effect acted on the spindle when the hammer claw impinged on the anvil claw, and therefore there was encountered a problem that the speed reduction mechanism portion and the housing, holding this speed reduction mechanism portion, were damaged.

SUMMARY OF THE INVENTION

This invention seeks to provide a power tool of a long lifetime which is enhanced in durability by overcoming the above problems and by damping a rotational impact force acting on a speed reduction mechanism portion.

The above object has been achieved by a power tool comprising a motor serving as a drive source, a speed reduction mechanism portion for transmitting a rotational power of the motor, a striking mechanism portion for converting the rotational power of the speed reduction mechanism portion into a striking force, and an end tool for outputting the striking force aid a rotational force through the striking mechanism portion; characterized in that there is provided an impact damping mechanism for damping an impact in a direction of rotation of the speed reduction mechanism portion.

DETAILED DESCRIPTION OF THE PREFERRED EMBODIMENTS

Figure 1:
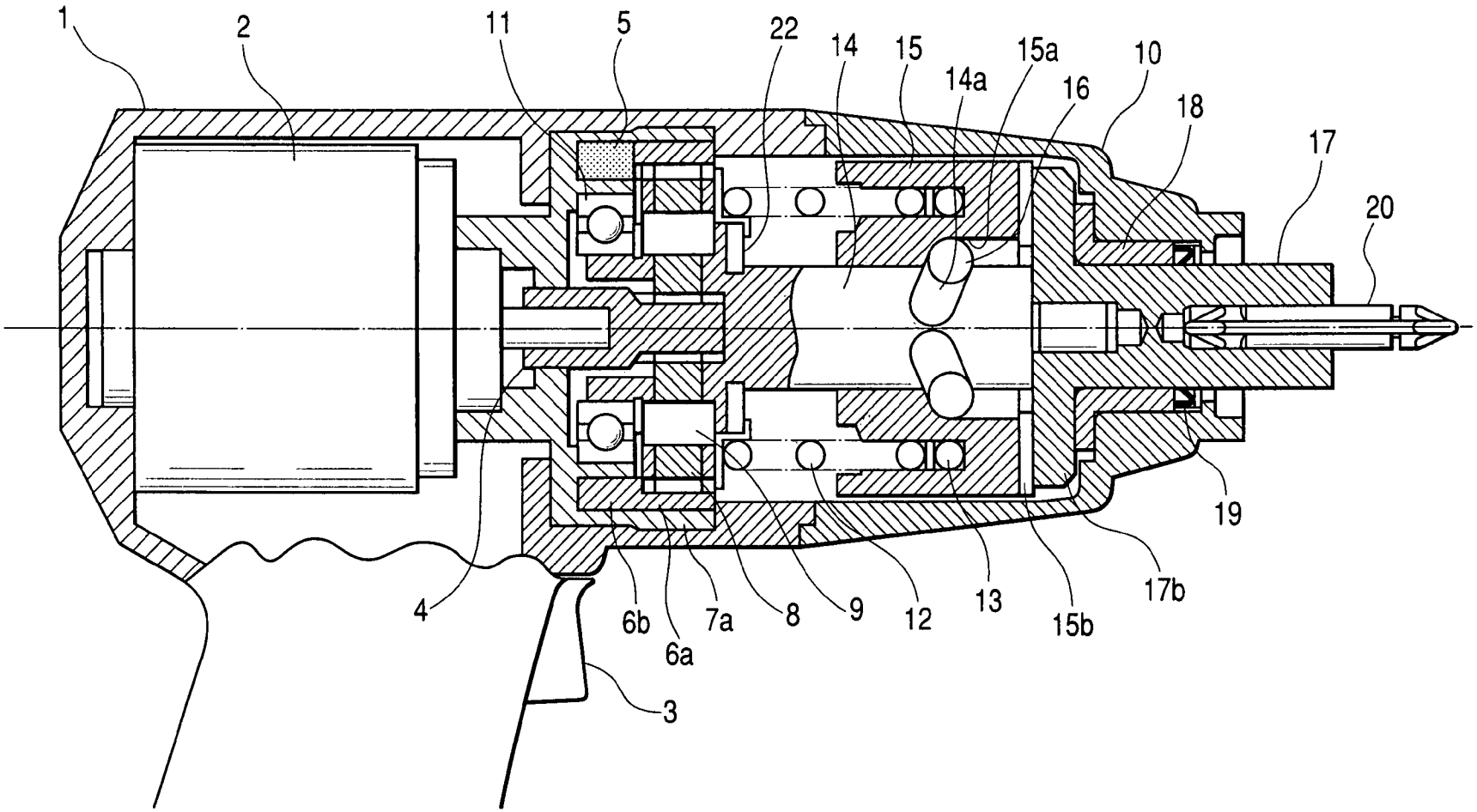
FIG. 1 is a partly-omitted, vertical cross-sectional, side-elevational view showing an impact tool of the present invention.
Figure 2:
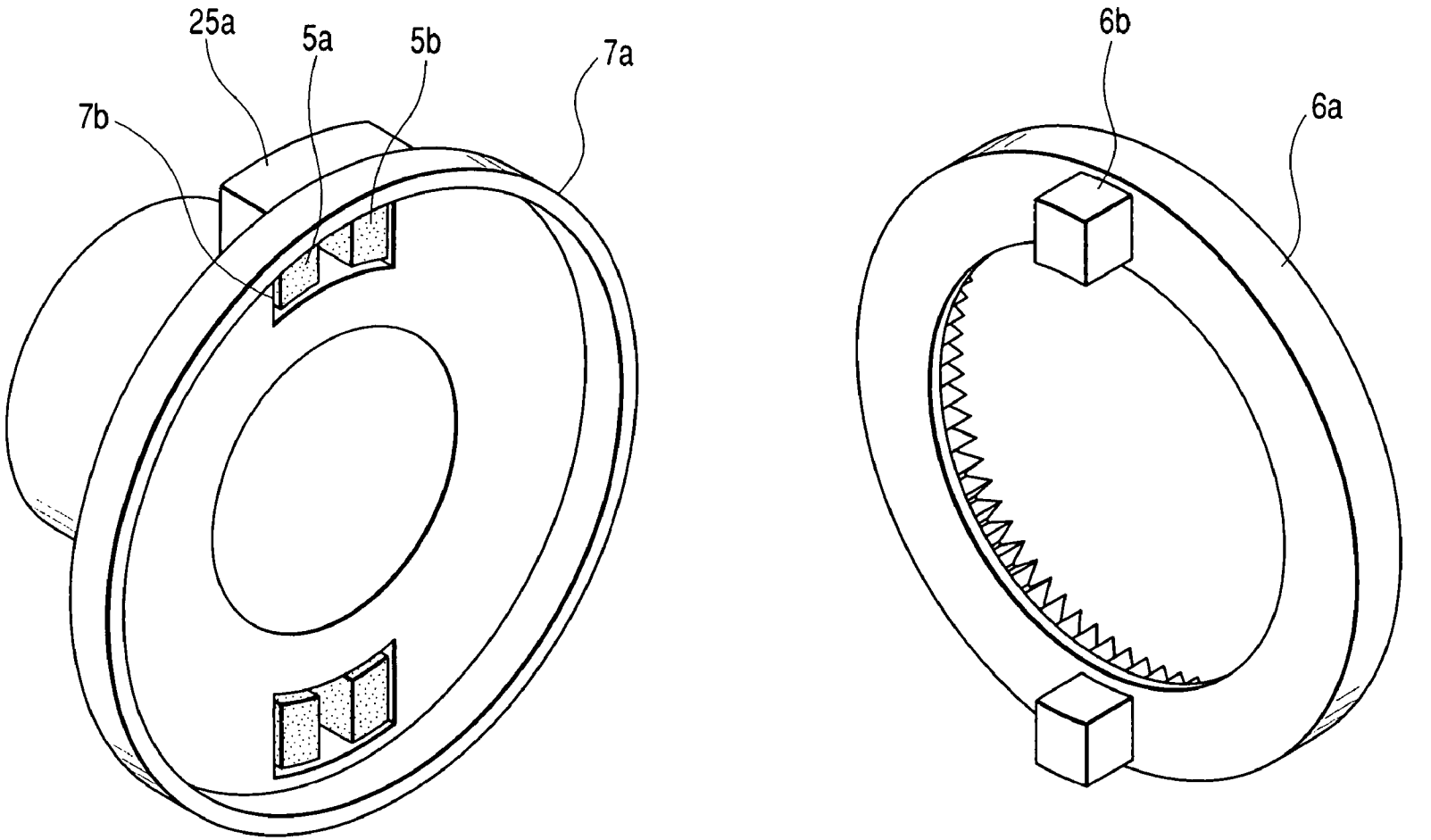
FIG. 2 is an exploded view showing a first embodiment of an impact damping mechanism mounted on the impact tool of FIG. 1.

An impact tool of this embodiment will now be described with reference to FIGS. 1 to 6. FIGS. 1 and 2 show a first embodiment, and FIG. 1 is a partly-omitted, vertical cross-sectional, side-elevational view showing the impact tool, and FIG. 2 is an exploded view showing an impact damping mechanism mounted on the impact tool. In FIGS. 1 and 2, a motor 2, serving as a drive source, a speed reduction mechanism portion 8 for transmitting a rotational power of a pinion 4 which is an output shaft of the motor 2, a spindle 14 for transmitting the rotational power from the speed reduction mechanism portion 8, a hammer 15, which is rotatable and movable in a direction of the axis of rotation through steel balls 16 inserted in cam grooves 14*a* formed in the spindle 14, an anvil 17, having anvil claws 17*b* which are struck by a plurality of hammer claws 15*b*, provided at the hammer 15, to be rotated, an end tool 20, releasably attached to the anvil 17, and a spring 12, normally urging the hammer 15 toward the anvil 17, are received within a housing 1 and a casing 10 which form a impact tool body of the impact tool. A striking mechanism portion mainly comprises the spring 12, the spindle 14, the hammer 15, the steel balls 16 and the anvil 17. The speed reduction mechanism portion includes a fixed gear support jig 7, which has rotation stoppers, and is supported against rotation within the housing 1, a fixed gear 6, planetary gears 8, and the spindle 14, and further includes needle pins 9 serving as rotation shafts for the planetary gears 8, and the gears 8 and the needle pins 9 form part of the spindle 14. One end the spindle 14 is borne by a bearing 11, and the other end thereof is rotatably supported in a central hole 17*a* in the anvil 17 rotatably supported by a metal bearing 18.

A trigger switch 3 is operated to supply electric power to the motor 2 to drive this motor 2 for rotation, and then the rotational power of this motor 2 is transmitted to the planetary gears 8 through the pinion 4 connected to the distal end of the motor 2, and the rotational power of the pinion 4 is transmitted to the spindle 14 through the needle pins 9 by the meshing engagement of the planetary gears 8 with the fixed gear 6, and the rotational force of the spindle 14 is transmitted to the hammer 15 through the steel balls 16 each disposed between the cam groove 14*a* of the spindle 14 and a cam groove 15*a* of the hammer 15, and the hammer claw 15*b* of the hammer 15, urged forward (toward the bit) by the spring 12 provided between the hammer 15 and the planetary gears 8 of the spindle 14, strikes the anvil claw 17*b* of the anvil 17 as a result of the rotation, thereby producing a pulse-like impact which is imparted to a screw, a nut or the like to be tightened by the end tool 20. After the striking operation, the striking energy of the hammer 15 decreases, and the torque of the anvil 17 decreases, whereupon the hammer 5 rebounds from the anvil 17, and therefore the hammer 15 moves toward the planetary gears 8 along the cam grooves 15*a* and 14*a*. Before the hammer 15 impinges on a stopper 22, the hammer 15 is again moved back along the cam grooves 15*a* and 14*a* toward the anvil 17 by the compressive force of the spring 12, and the hammer 15 is accelerated by the rotation of the spindle 14 through the steel balls 16 each disposed between the cam groove 14*a* of the spindle 14 and the cam groove 15*a* of the hammer 15. During the reciprocal movement of the hammer 15 toward the stopper 22 along the cam grooves 14*a* and 15*a*, the spindle 14 continues to rotate, and therefore in the case where the hammer claw 15*b* of the hammer 15 moves past the anvil claw 17*b* of the anvil 17, and again strikes the anvil claw 17*b*, the hammer 15, when rotated through 180°, strikes the anvil 17. Thus, the anvil 17 is repeatedly struck by the axial movement and rotation of the hammer 15, and by doing so, the screw or the like is tightened while continuously imparting the impact torque thereto.

The impact damping mechanism is mounted on the thus operating impact tool, and as shown in FIG. 2, this impact damping mechanism comprises the fixed gear support jig 7*a*, which has the rotation stoppers 25*a* the direction of rotation of which is fixed within the housing 1, and has a circular outer peripheral portion, and has its center held in a predetermined position relative to the housing 1, the fixed gear 6*a*, which is held within an inner periphery of the fixed gear support jig 7*a* so as to rotate very slightly, with its center held in a predetermined position, and impact damping members 5*a* and 5*b* which are inserted in holes 7*b*, formed in the fixed gear support jig 7*a*, and engage projections 6*b* formed on a side surface of the fixed gear 6*a*.

With this impact damping mechanism, when the hammer 15 moves toward the planetary gears 8 along the cam grooves 15*a* and 14*a*, and impinges on the stopper 22, the pinion 4 is always rotating, but the claws 6*b* of the fixed gear 6 compress the impact damping members 5*a* and 5*b*, and therefore the impact force in the rotational direction can be damped by the very slight rotation of the fixed gear 6*a*. In this construction, the impact damping members 5*a* and 5*b* are provided in a gap between the bearing 11, which is the rear bearing for the spindle 14, and the housing 1, and therefore the damping mechanism can be provided effectively without increasing the overall length of the tool. And besides, the impact damping members 5*a* and 5*b* are arranged in the direction of the rotational load, and are provided on opposite sides of the projection 6*b*, respectively, and therefore can meet the normal and reverse rotation of the motor 2 and the vibration of the load. The number of the projections 6*b* is not limited to two as in the illustrated example, but at least one projection need only to be provided.

Figure 3:
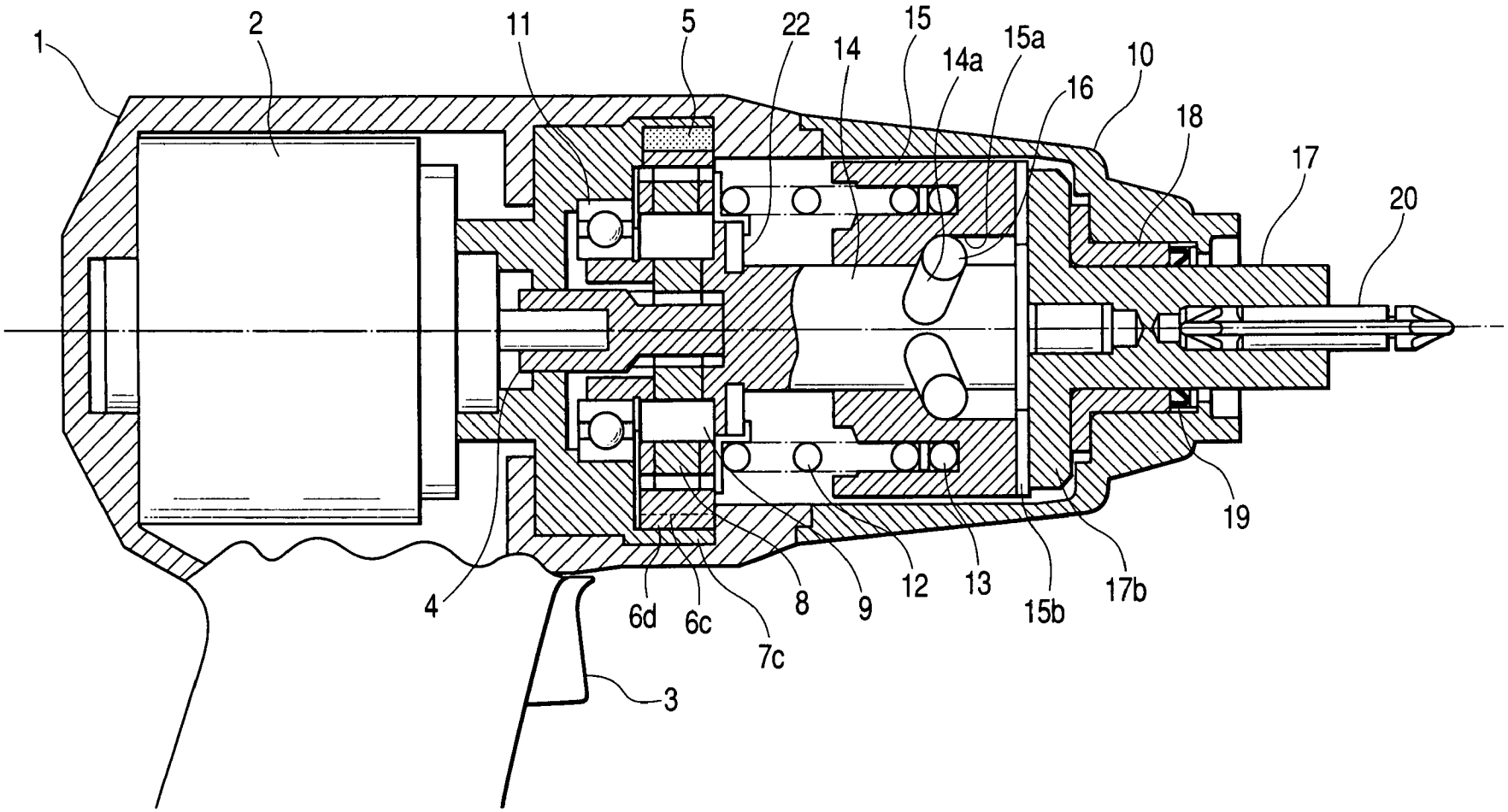
FIG. 3 is a partly-omitted, vertical cross-sectional, side-elevational view showing an impact tool of the present invention.
Figure 4:
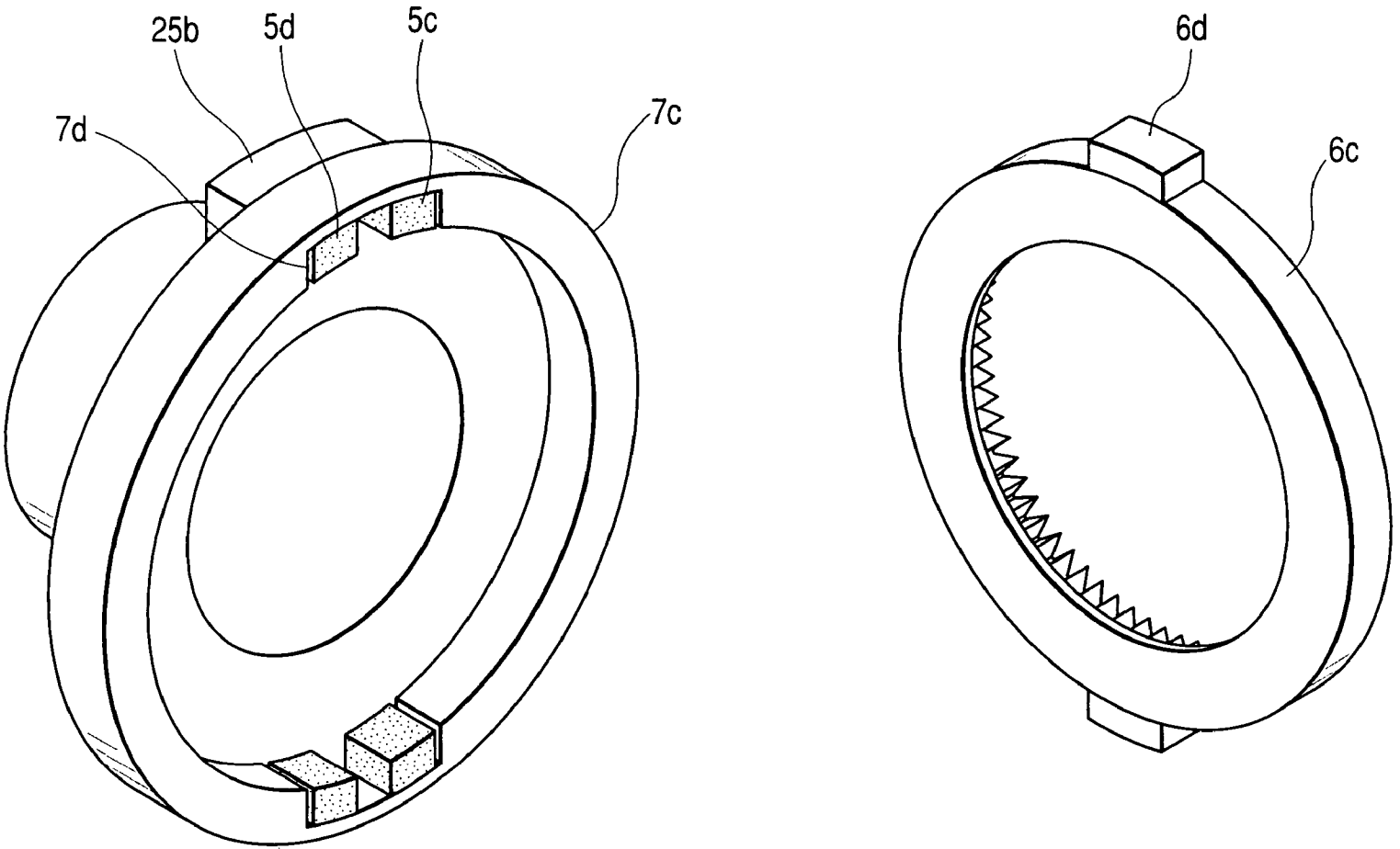
FIG. 4 is an exploded view showing a second embodiment of an impact damping mechanism mounted on the impact tool of FIG. 3.

FIGS. 3 and 4 show a second embodiment, and FIG. 3 is a partly-omitted, vertical cross-sectional, side-elevational view showing an impact tool, and FIG. 4 is an exploded view showing an impact damping mechanism mounted on the impact tool. The impact damping mechanism is mounted on the impact tool shown in FIG. 3, and in this impact damping mechanism, projections 6*d* are formed on an outer surface of a fixed gear 6*c* as shown in FIG. 4, and holes 7*d* are formed respectively in those portions of a fixed gear support jig 7*c* (which is mounted within a housing 1) corresponding respectively to the projections 6*d* on the outer surface of the fixed gear 6*c*, and impact damping members 5*c* and 5*d* are inserted in these holes 7*d*.

In this impact damping mechanism, the fixed gear 6*c* is combined with the fixed gear support jig 7*c* in such a manner that the projection 6*d* of the fixed gear 6*c* is inserted between the impact damping members 5*c* and 5*d*. Therefore, the load is supported at a more radially-outward side of the fixed gear 6*c* as compared with the impact damping mechanism shown in FIGS. 1 and 2, and therefore the load can be damped more effectively. Although the outer diameter of the fixed gear support jig 7*c* and the size of the housing 1 are slightly increased, the sufficient effect can be obtained.

Figure 5:
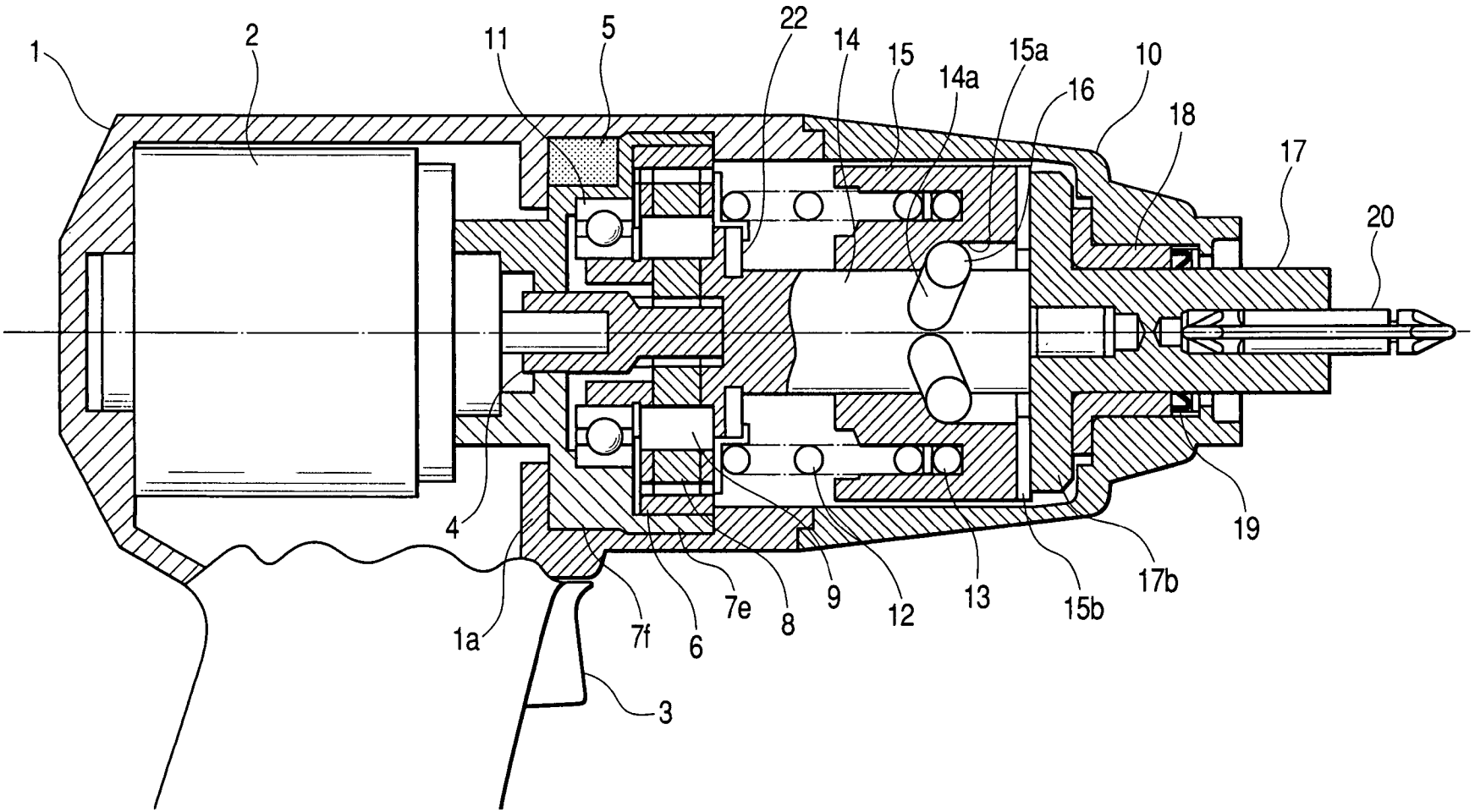
FIG. 5 is a partly-omitted, vertical cross-sectional, side-elevational view showing an impact tool of the present invention.
Figure 6:
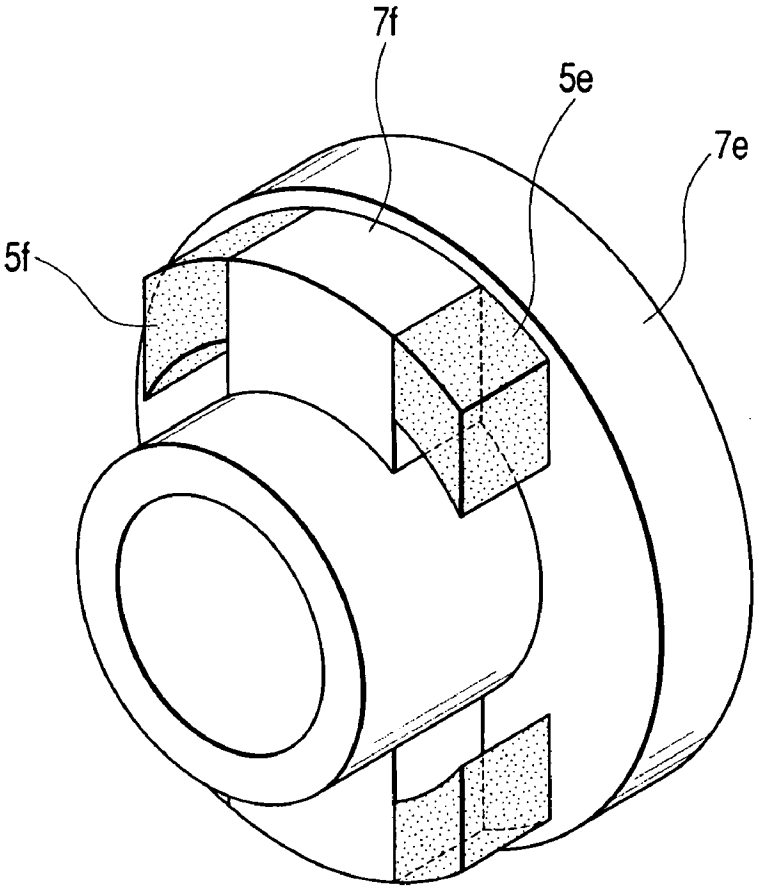
FIG. 6 is an exploded view showing a third embodiment of an impact damping mechanism mounted on the impact tool of FIG. 5.
Figure 8:
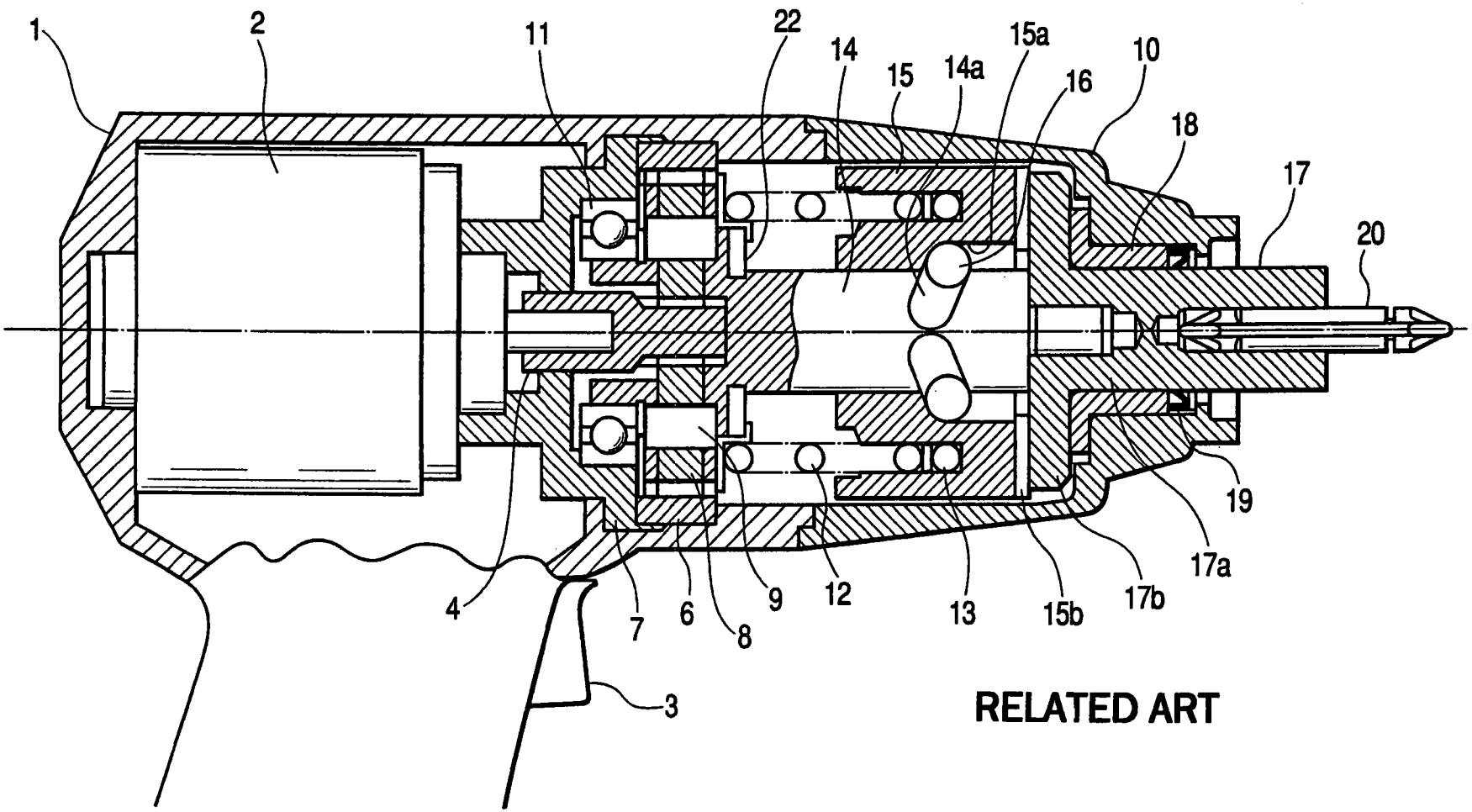
FIG. 8 is a partly-omitted, vertical cross-sectional, side-elevational view showing a conventional impact tool.

FIGS. 5 and 6 show a third embodiment, and FIG. 5 is a partly-omitted, vertical cross-sectional, side-elevational view showing an impact tool, and FIG. 6 is an exploded view showing an impact damping mechanism mounted on the impact tool. The impact damping mechanism is mounted on the impact tool shown in FIG. 5, and in this impact damping mechanism, a fixed gear 6 and a fixed gear support jig 7*e* are fixedly secured to each other as shown in FIG. 6, and impact damping members 5*e* and 5*f* are provided respectively on opposite sides of each of projections 7*f* which are rotation stoppers for preventing the rotation of the fixed gear support jig 7*e* relative to a housing 1.

In this impact damping mechanism, that side of each impact damping member 5*e*, 5*f*, facing in the same direction as the projection 7*f*, is held by a rib 1*a* of the housing 1 of the body, and besides the impact damping members 5*e* and 5*f* are provided between a bearing 11 and the housing 1, and therefore a rotational impact force can be damped without increasing the overall length.

Figure 7:
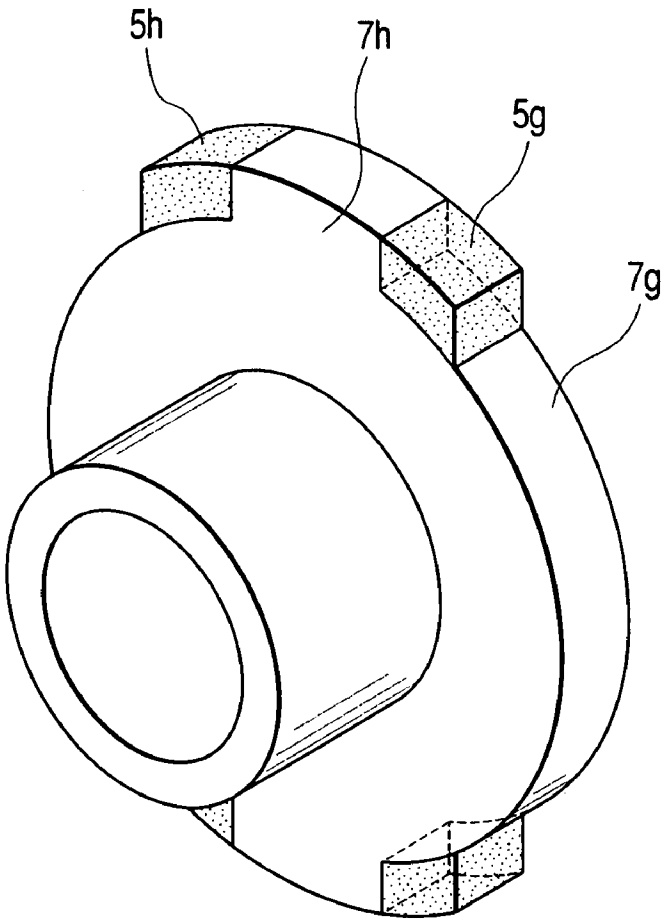
FIG. 7 is a perspective appearance view showing a fourth embodiment of an impact damping mechanism mounted on an impact tool of the invention.

FIG. 7 shows a fourth embodiment, and is a perspective appearance view showing an impact damping mechanism mounted on an impact tool. In the thus mounted impact damping mechanism, as shown in FIG. 7, a fixed gear 6 and a fixed gear support jig 7*g* are fixedly secured to each other, and projections 7*h* are formed on an outer surface of the fixed gear support jig 7*g*, and each of impact damping members 5*g* and 5*h* is arranged between that side of the projection 7*h*, facing in the direction of rotation, and a rib (not shown) of a housing 1.

In this impact damping mechanism, the load is supported at a more radially-outward side as compared with the impact damping mechanism shown in FIG. 6, and therefore the load can be damped more effectively as compared with the mechanism of FIG. 6. Although the outer diameter of the fixed gear support jig 7*g* and the size of the housing 1 are slightly increased, the sufficient effect can be obtained.

By combining the above-mentioned impact damping mechanisms, the rotational impact between the fixed gear 6 and the housing 1 can be further reduced, and preferably any one of various vibration-insulating rubber, soft plastics materials, felts and so on, which have a damping effect, is used as the impact damping material 5.

In the present invention, the rotational impact force of the speed reduction mechanism portion, produced by the abrupt acceleration of the impact mechanism portion, is damped, and by doing so, the jig, supporting the speed reduction mechanism portion, or the housing is enhanced in durability, so that the lifetime of the tool can be increased. And besides, the load, acting on the various portions, is reduced, and therefore materials, of which the various portions are made, can be changed to inexpensive, low-grade materials. By inserting the impact damping members between the bearing of the impact mechanism portion or the bearing of the speed reduction mechanism portion and the housing, a more compact-size design can be achieved.

By damping the abrupt rotational impact force, the vibration of the housing or the vibration of the motor, connected to the speed reduction mechanism portion, is reduced, and the operator, holding the impact tool, is less fatigued even when he uses the tool for a long period of time, and therefore the efficiency of the operation can be enhanced, and noises, produced by the vibration, can be reduced.

What is claimed is:

1. A power tool comprising:

a housing;

a motor comprising an output shaft; and a speed reduction mechanism comprising:

a pinion gear connected to the output shaft;

a planetary gear disposed around the pinion gear and engaged with the pinion gear;

a fixed gear surrounding the planetary gear and engaged with the planetary gear;

a support member holding the fixed gear, said support member comprising:

an outer surface held by the housing;

an inner surface holding the fixed gear;

a bearing disposed coaxially with the fixed gear; and a rotation stopper engaged with the housing thereby preventing the support member from rotating; and a spindle connected to the planetary gears and held by the bearing;

a mechanism portion connected to the spindle and transmitting a rotational power of the speed reduction mechanism to an end tool;

a first projection extending from a side surface of the fixed gear; and a first hole formed on the support member radially outward of the bearing and holding the first projection thereby limiting a rotation of the fixed gear, wherein the first projection, the first hole and the bearing are aligned in the radial direction of the bearing.

2. The power tool of claim 1, wherein the first projection, the first hole and the bearing are disposed in front of the motor, wherein the pinion gear, the planetary gear and the fixed gear are disposed in front of the bearing, and wherein the spindle extends from the bearing to the front direction.

3. The power tool of claim 2, further comprising:

a cam formed on the spindle and disposed in front of the bearing;

a hammer disposed around the cam and connected to the spindle via the cam, the hammer being axially movable along the axial direction of the spindle; and an anvil disposed in front of the spindle and holding the end tool, the anvil being engageable with the hammer.

4. The power tool of claim 1, further comprising:

a handle extending substantially downward from the housing, wherein the first projection and the first hole are disposed laterally from the bearing.

5. The power tool of claim 4, further comprising:

a second projection extending from the side surface of the fixed gear in the opposite side of the first projection; and a second hole formed on the supporting member and holding the second projection.

* * * * *